US009130302B1

(12) United States Patent
Yang et al.

(10) Patent No.: US 9,130,302 B1
(45) Date of Patent: Sep. 8, 2015

(54) AUDIO JACK CONNECTOR

(71) Applicant: Cheng Uei Precision Industry Co., Ltd., New Taipei (TW)

(72) Inventors: Cheng Wang Yang, Dong-Guan (CN); Chao Yong Ye, Dong-Guan (CN); Kai Hsiang Chang, New Taipei (TW)

(73) Assignee: CHENG UEI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/328,700

(22) Filed: Jul. 10, 2014

(51) Int. Cl.
*H01R 24/04* (2006.01)
*H01R 13/52* (2006.01)
*H01R 24/58* (2011.01)

(52) U.S. Cl.
CPC ..... *H01R 13/521* (2013.01); *H01R 24/58* (2013.01)

(58) Field of Classification Search
USPC ..... 439/668, 669, 519, 271
IPC ..... H01R 24/58,2130/00, 2107/00, 11/281, H01R 13/5216, 13/5219
See application file for complete search history.

(56) References Cited

U.S. PATENT DOCUMENTS

| | | | | |
|---|---|---|---|---|
| 7,470,153 | B2 * | 12/2008 | Han et al. | 439/669 |
| 8,123,569 | B2 * | 2/2012 | Little et al. | 439/669 |
| 8,616,922 | B2 * | 12/2013 | Liu et al. | 439/669 |
| 8,668,528 | B2 * | 3/2014 | Rothkopf et al. | 439/669 |
| 2008/0032562 | A1 * | 2/2008 | McHugh et al. | 439/668 |

* cited by examiner

*Primary Examiner* — Hien Vu
(74) *Attorney, Agent, or Firm* — Cheng-Ju Chiang

(57) ABSTRACT

An audio jack connector includes an insulating housing which has a base body defining a holding cavity in a bottom thereof and an inserting body defining an inserting chamber, a plurality of electrical terminals disposed in the base body, a fixing member fastened in the holding cavity of the insulating housing to cover and hold the electrical terminals in the base body, and a sealing tape covering under the fixing member and adhered outside the insulating housing and the fixing member to seal up splicing gaps between sidewalls of the holding cavity and peripheral edges of the fixing member. So the audio jack connector can effectively prevent the water vapor and dust passing through the inserting chamber onto a printed circuit board of an electronic product where the audio jack connector is used.

5 Claims, 4 Drawing Sheets

AUDIO JACK CONNECTOR

BACKGROUND OF THE INVENTION

1. Field of the Invention

The present invention relates to a connector, and more particularly to an audio jack connector.

2. the Related Art

Along with the development of modern information technology, audio jack connectors are more and more widely used in various electronic products for connecting with matching plug connectors to transmit audio signals. In recent years, along with the appearance of a variety of compact electronic products such as mobile phones, PDA, MP3 players and laptops, the audio jack connectors become particularly important for the electronic products.

A known audio jack connector includes an insulating housing and a plurality of electrical terminals which are installed in the insulating housing. The insulating housing defines an inserting chamber longitudinally running through the insulating housing, and a plurality of terminal grooves arranged alongside the inserting chamber and communicated with the inserting chamber. The electrical terminals are disposed in the terminal grooves, wherein each electrical terminal has one end project into the inserting chamber for electrically connecting with the matching plug connector, and the other end be exposed outside the insulating housing for electrically connecting with a printed circuit board of the electronic product, so as to realize an electrical connection between the electronic product and the matching plug connector.

However, in use, water vapor and dust easily pass through the inserting chamber and the terminal grooves onto the printed circuit board of the electronic product. As a result, the service life of the electronic product is greatly reduced.

SUMMARY OF THE INVENTION

Accordingly, an object of the present invention is to provide an audio jack connector. The audio jack connector includes an insulating housing, a plurality of electrical terminals, a fixing member and a sealing member. The insulating housing has a base body and an inserting body which is integrally formed to one side of the base body. A front face of the inserting body is concaved rearward to form an inserting chamber. A bottom face of the base body defines a holding cavity of which a top inner wall defines a plurality of terminal grooves arranged alongside the inserting body and each further extending sideward through the inserting body to communicate with the inserting chamber. The electrical terminals are disposed in the terminal grooves of the insulating housing. Each electrical terminal has a contact portion projecting into the inserting chamber and a welding block located away from the inserting body. The fixing member is fastened in the holding cavity of the base body, covers and holds the electrical terminals in the terminal grooves. The sealing member includes a sealing tape covering under the fixing member and adhered outside the insulating housing and the fixing member to seal up splicing gaps between sidewalls of the holding cavity and peripheral edges of the fixing member. The welding blocks of the electrical terminals penetrate through the fixing member and the sealing tape to be exposed outside.

As described above, the sealing tape of the sealing member is adhered outside the insulating housing and the fixing member to seal up the splicing gaps between the sidewalls of the holding cavity and the peripheral edges of the fixing member. So it can effectively prevent the water vapor and dust passing through the inserting chamber and the terminal grooves onto a printed circuit board of an electronic product welded with the welding blocks of the electrical terminals.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
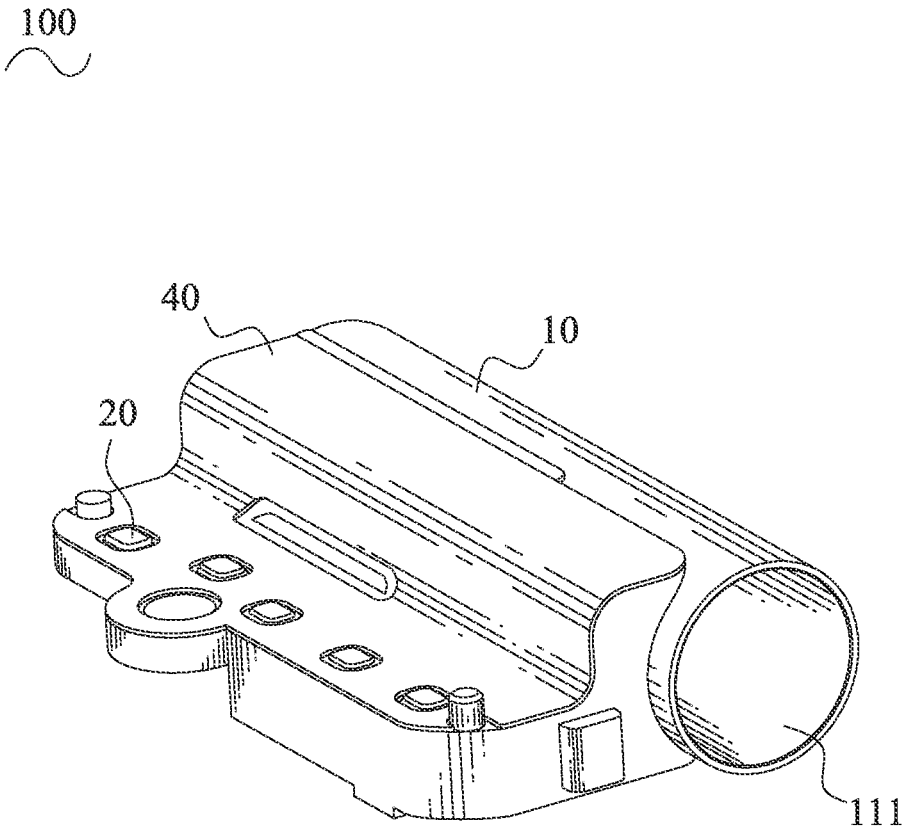
FIG. 1 is a perspective view of an audio jack connector according to an embodiment of the present invention.
Figure 2:
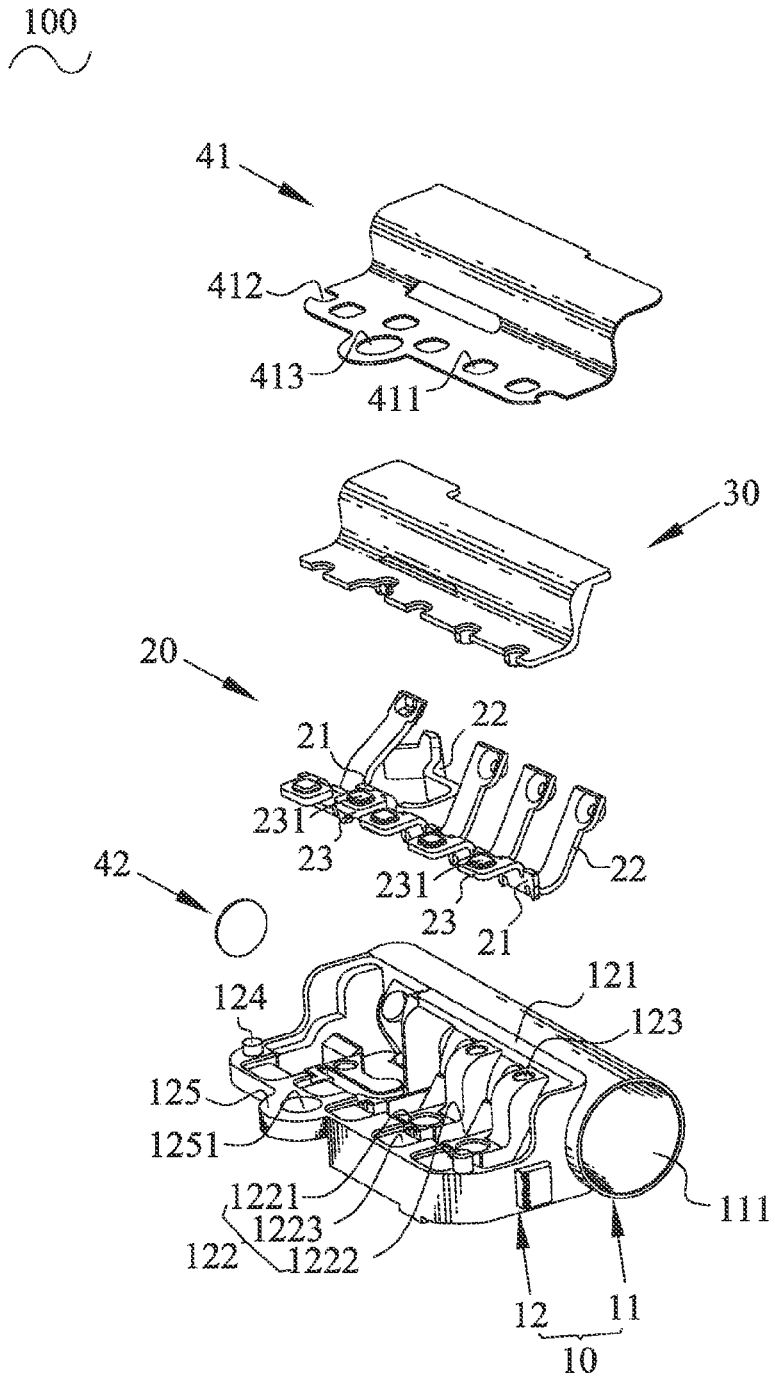
FIG. 2 is an exploded view of the audio jack connector of FIG. 1.
Figure 3:
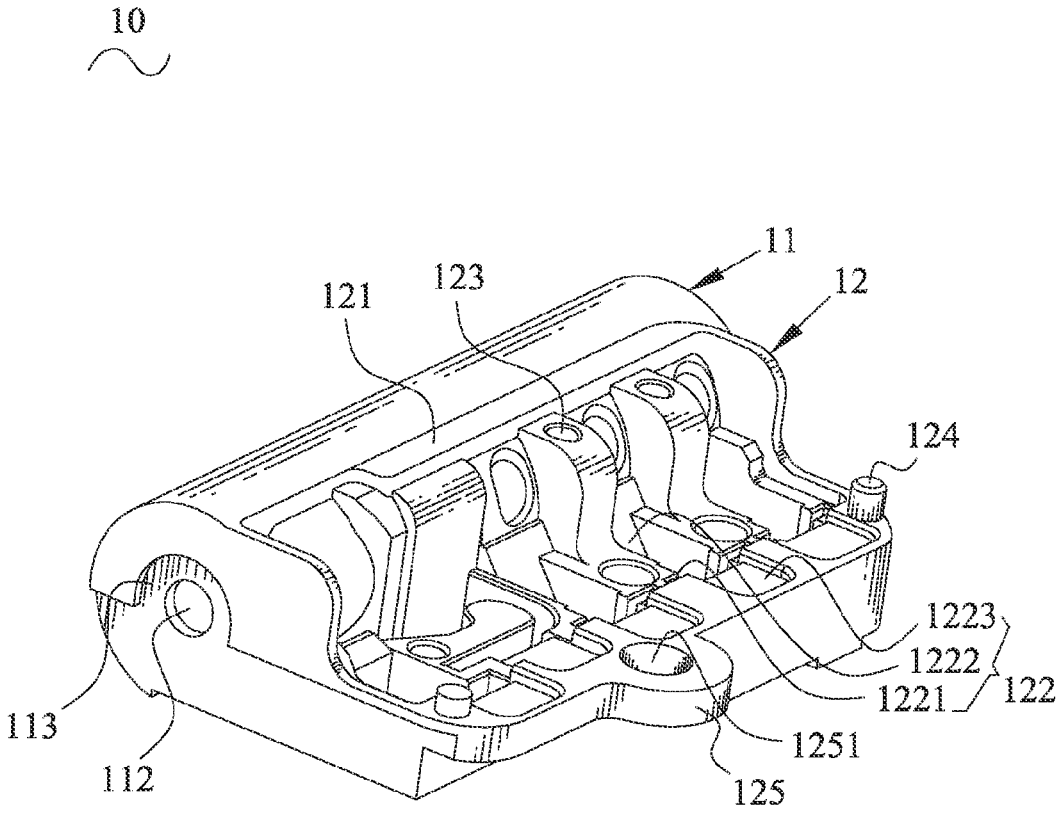
FIG. 3 is a perspective view of an insulating housing of the audio jack connector of FIG. 1.

With reference to FIGS. 1 to 3, an embodiment of the present invention is embodied in an audio jack connector 100. The audio jack connector 100 includes an insulating housing 10, a plurality of electrical terminals 20, a fixing member 30 and a sealing member 40.

The insulating housing 10 has a substantially cuboid base body 12 and a columnar inserting body 11 which is integrally formed to one side of the base body 12. A front face of the inserting body 11 is concaved rearward to form an inserting chamber 111. A rear end of the inserting chamber 111 of the insulating housing 10 further penetrates rearward through a back face of the inserting body 11 to form a through aperture 112. The back face of the inserting body 11 is concaved forward to form a mounting groove 113 where the through aperture 112 is. A bottom face of the base body 12 defines a holding cavity 121 (In this embodiment of the invention, defining the face with the holding cavity 121 as the bottom of the insulating housing 10) of which a top inner wall defines a plurality of terminal grooves 122 arranged alongside the inserting body 11 and each further extending sideward through the inserting body 11 to communicate with the inserting chamber 111. Each terminal groove 122 includes a fastening groove 1221, a through groove 1222 and a positioning groove 1223, where the through groove 1222 and the positioning groove 1223 are connected with two ends of the fastening groove 1221 respectively. The through groove 1222 is communicated with the inserting chamber 111. A bottom face of a wall between every two adjacent terminal grooves 122 of the base body 12 is concaved upward to form at least one fixing hole 123. Both ends of the bottom face of the base body 12 protrude downward to form a fixing block 124 respectively. One side of the base body 12 away from the inserting body 11 protrudes outward to form a mounting portion 125 substantially arranged in the middle thereof. A first mounting hole 1251 is opened through the mounting portion 125 to make the audio jack connector 100 be mounted on an electronic product (not shown).

Referring to FIG. 2, the electrical terminals 20 are disposed in the terminal grooves 122 of the insulating housing 10. Each of the electrical terminals 20 has a board-shaped fastening portion 21 vertically fastened in the fastening groove 1221 of the terminal groove 122. A contact portion 22 extends toward the inserting chamber 111 from the top edge of the fastening portion 21 and is received in the through groove 1222, wherein the contact portion 22 further projects into the inserting chamber 111. A bottom edge of the fastening portion 21 is bent outward and then extends oppositely to the contact portion 22 to form a positioning plate 23 located away from the inserting body 11 and positioned in the positioning groove 1223. A bottom face of the positioning plate 23 protrudes downward to form a welding block 231 projecting under the bottom face of the base body 12.

Figure 4:
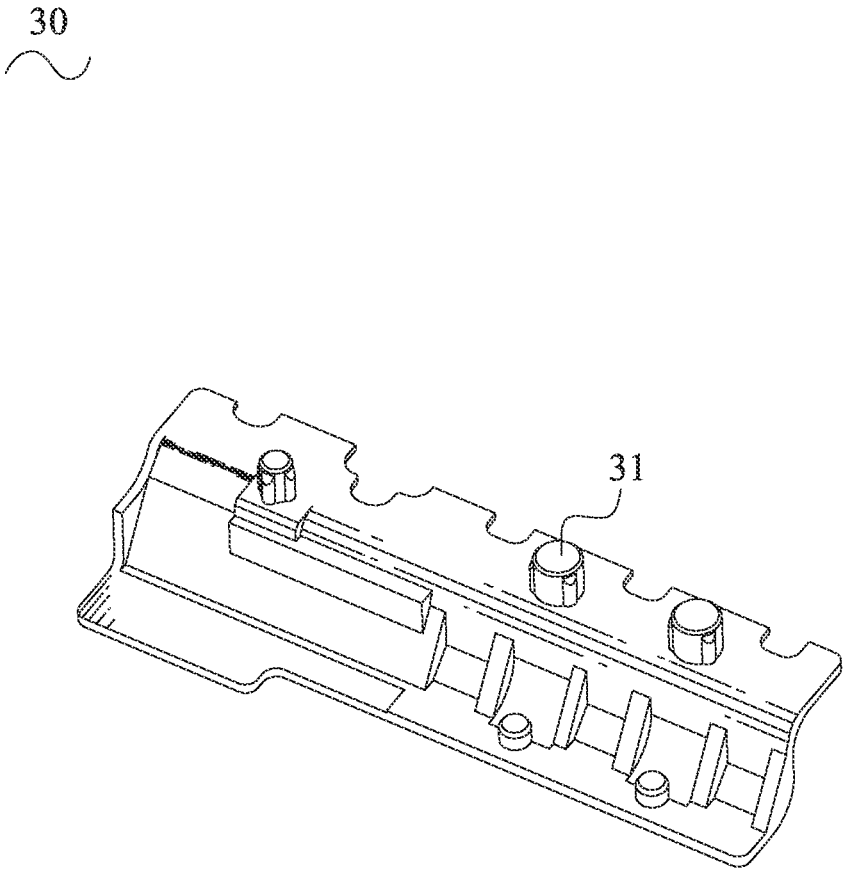
FIG. 4 is a perspective view of a fixing member of the audio jack connector of FIG. 1.

Referring to FIG. 2 and FIG. 4, the fixing member 30 is fastened in the holding cavity 121 of the base body 12 to cover and hold the electrical terminals 20 in the terminal grooves 122 with the welding blocks 231 of the electrical terminals 20 penetrating through the fixing member 30 to be exposed outside. A top face of the fixing member 30 protrudes upward to form a plurality of fixing columns 31 corresponding to the fixing holes 123 of the base body 12 and fixed in the fixing holes 123 of the base body 12.

Referring to FIG. 2 and FIG. 3, the sealing member 40 includes a sealing tape 41 and a sealing fin 42. The sealing tape 41 covers under the fixing member 30 and is adhered outside the insulating housing 10 and the fixing member 30 to seal up splicing gaps between sidewalls of the holding cavity 121 and peripheral edges of the fixing member 30. The welding blocks 231 of the electrical terminals 20 further penetrate through the sealing tape 41 to be exposed outside. The sealing tape 41 defines a plurality of through holes 411 arranged side-by-side at one side thereof and corresponding to the welding blocks 231 of the electrical terminals 20. The welding blocks 231 pass downward through the through holes 411 to project under the sealing tape 41. Both ends of the sealing tape 41 corresponding to the fixing blocks 124 of the base body 12 define a fixing aperture 412 respectively. The fixing blocks 124 of the base body 12 are buckled in the fixing apertures 412 of the sealing tape 41. A part of the sealing tape 41 corresponding to the mounting portion 125 of the base body 12 defines a second mounting hole 413 vertically aligned with the first mounting hole 1251 of the insulating housing 10 for further reinforcing the sealing tape 41 and the insulating housing 10 together. The sealing fin 42 is in accordance with the mounting groove 113 of the inserting body 11 and is adhered in the mounting groove 113 to seal up the through aperture 112 so as to achieve the effect of waterproof.

As described above, the sealing tape 41 of the sealing member 40 is adhered outside the insulating housing 10 and the fixing member 30 to seal up the splicing gaps between the sidewalls of the holding cavity 121 and the peripheral edges of the fixing member 30, and furthermore, the sealing fin 42 is adhered in the mounting groove 113 to seal up the through aperture 112. So that can effectively prevent the water vapor and dust passing through the inserting chamber 111 and the terminal grooves 122 onto a printed circuit board of an electronic products welded with the welding blocks 231 of the electrical terminals 20.

What is claimed is:

1. An audio jack connector, comprising:

an insulating housing having a base body and an inserting body which is integrally formed to one side of the base body, a front face of the inserting body being concaved rearward to form an inserting chamber, a bottom face of the base body defining a holding cavity of which a top inner wall defines a plurality of terminal grooves arranged alongside the inserting body and each further extending sideward through the inserting body to communicate with the inserting chamber;

a plurality of electrical terminals disposed in the terminal grooves of the insulating housing, each electrical terminal having a contact portion projecting into the inserting chamber and a welding block located away from the inserting body;

a fixing member fastened in the holding cavity of the base body, covering and holding the electrical terminals in the terminal grooves; and a sealing member including a sealing tape, the sealing tape completely covering the fixing member and being adhered outside the insulating housing and the fixing member to seal up splicing gaps between sidewalls of the holding cavity and peripheral edges of the fixing member, the welding blocks of the electrical terminals penetrating through the fixing member and the sealing tape to be exposed outside;

wherein the sealing tape defines a plurality of through holes arranged side-by-side at one side thereof and corresponding to the welding blocks of the electrical terminals, the welding blocks pass through the through holes to project from under the sealing tape; and wherein a bottom face of a wall between every two adjacent terminal grooves of the base body is concaved upward to form at least one fixing hole, a top face of the fixing member protrudes upward to form a plurality of fixing columns corresponding to the fixing holes of the base body and fixed in the fixing holes of the base body.

2. The audio jack connector as claimed in claim 1, wherein each terminal groove includes a fastening groove, a through groove and a positioning groove, where the through groove and the positioning groove are connected with two ends of the fastening groove respectively, the through groove is communicated with the inserting chamber, each of the electrical terminals has a board-shaped fastening portion vertically fastened in the fastening groove of the terminal groove, a contact portion extends toward the inserting chamber from a top edge of the fastening portion and is received in the through groove, and a bottom edge of the fastening portion is bent outward and then extends oppositely to the contact portion to form a positioning plate positioned in the positioning groove, a bottom face of the positioning plate protrudes downward to form the welding block.

3. The audio jack connector as claimed in claim 1, wherein both ends of a bottom face of the base body protrude downward to form a fixing block respectively, both ends of the sealing tape corresponding to the fixing blocks of the base body define a fixing aperture respectively, the fixing blocks of the base body are buckled in the fixing apertures of the sealing tape.

4. The audio jack connector as claimed in claim 1, wherein one side of the base body away from the inserting body protrudes outward to form a mounting portion substantially arranged in the middle thereof, a first mounting hole is opened through the mounting portion, a part of the sealing tape corresponding to the mounting portion of the base body defines a second mounting hole vertically aligned with the first mounting hole of the insulating housing.

5. The audio jack connector as claimed in claim 1, wherein a rear end of the inserting chamber of the insulating housing further penetrates rearward through a back face of the inserting body to form a through aperture, the back face of the inserting body is concaved forward to form a mounting groove where the through aperture is, the sealing member further includes a sealing fin corresponding to the mounting groove of the inserting body, the sealing fin is adhered in the mounting groove and seals up the through aperture.

* * * * *